United States Patent [19]

Colvin

[11] Patent Number: 4,718,135

[45] Date of Patent: Jan. 12, 1988

[54] SHOE TREE WITH HORN

[76] Inventor: Timothy E. Colvin, 8 Wildwood Gardens, Piedmont, Calif. 94611

[21] Appl. No.: 45,364

[22] Filed: May 1, 1987

Related U.S. Application Data

[63] Continuation-in-part of Ser. No. 869,358, Jun. 2, 1986, abandoned, which is a continuation of Ser. No. 680,821, Dec. 12, 1984, abandoned.

[51] Int. Cl.[4] ..... A43D 3/14; A43D 3/00

[52] U.S. Cl. ..... 12/115.8; 12/115.6; 12/114.2

[58] Field of Search ..... 12/128 R, 133 R, 135 R, 12/135 A, 136 R, 136 A, 136 B, 136 C, 114.2, 115.6, 115.8, 116.2, 116.4, 116.6, 117.4; 223/113, 118, 119

[56] References Cited

U.S. PATENT DOCUMENTS

| | | | |
|---|---|---|---|
| 612,870 | 10/1898 | Ryder et al. | 12/115.8 |
| 818,960 | 4/1906 | Higgins | 12/115.6 |
| 947,387 | 1/1910 | Kosters | 12/115.6 |
| 1,110,917 | 9/1914 | Fitz | 12/115.6 |
| 1,527,662 | 2/1925 | Anderson | 12/115.8 |
| 1,599,900 | 9/1926 | Kosters | 12/115.8 |
| 1,830,016 | 11/1931 | Clausing | 12/115.8 |
| 1,994,569 | 3/1935 | Clark | 12/136 R |
| 2,158,394 | 5/1939 | Baas | 12/115.6 |
| 2,203,792 | 6/1940 | Loney | 12/115.8 |
| 2,215,835 | 9/1940 | Mutch | 12/115.8 |
| 2,255,471 | 9/1941 | Mutch | 12/115.8 |
| 2,275,072 | 3/1942 | Bradshaw | 12/115.6 |
| 2,357,687 | 9/1944 | Reinhardt | 12/115.6 |
| 4,113,159 | 9/1978 | Allsop | 224/455 |

FOREIGN PATENT DOCUMENTS

| | | | |
|---|---|---|---|
| 309504 | 1/1918 | Fed. Rep. of Germany | 12/135 R |
| 862719 | 11/1952 | Fed. Rep. of Germany | 12/128 R |
| 3431904 | 3/1980 | Fed. Rep. of Germany | 12/114.2 |
| 3316165 | 11/1984 | Fed. Rep. of Germany | 12/114.2 |
| 388325 | 4/1908 | France | 12/115.6 |
| 697665 | 11/1930 | France | 12/115.6 |
| 723405 | 4/1932 | France | 12/115.6 |
| 1195406 | 11/1959 | France | 12/135 A |
| 15701 | of 1888 | United Kingdom | 12/114.2 |
| 20271 | of 1901 | United Kingdom . | |

*Primary Examiner*—Werner H. Schroeder
*Assistant Examiner*—Steven N. Meyers
*Attorney, Agent, or Firm*—Limbach, Limbach & Sutton

[57] ABSTRACT

A shoe tree (10) having toe and heel engaging portions (12, 14) connected together for articulated movement between an extended generally longitudinally aligned condition and a retracted non-aligned condition. A shoe horn (50) secured to and extending from the heel engaging portion (14) provides a lever to facilitate its movement between the extended and retracted conditions.

10 Claims, 9 Drawing Figures

SHOE TREE WITH HORN

DESCRIPTION

RELATED APPLICATIONS

The present application is a continuation-in-part of co-pending application Ser. No. 869,358, filed June 2, 1986, which in turn is a continuation of application Ser. No. 680,821, filed Dec. 12, 1984, both now abandoned.

BACKGROUND OF THE INVENTION

The present invention relates to a shoe tree and, more particularly, is directed to such a tree incorporating a shoe horn. In its more specific aspects, the invention is concerned with a combined shoe tree and horn wherein the horn serves as a lever to facilitate placement and removal of the tree Shoe trees are very well known in the prior art. The more popular current trees incorporate heel and toe engaging portions with some type of compression strut therebetween. The strut telescopes to facilitate insertion and removal of the tree. It also serves to impart compressive force to the interior of a shoe within which the tree is received. In the more sophisticated shoe trees, the forward toe-engaging portion of the tree is expandible in response to the compressive force applied thereto by the strut.

Certain prior art shoe trees have also employed heel and toe-engaging portions which may serve as a shoe horn when the tree is removed from a shoe. Such a device may be seen in Canadian Pat. No. 637,524, issued Mar. 6, 1962. In that device, however, the horn construction did not serve as a lever to facilitate placement and removal of the tree.

SUMMARY OF THE INVENTION

The shoe tree of the present invention comprises heel and toe-engaging portions connected together by compression means which function to impart internal compressive force to the interior of a shoe within which the tree is received. A shoe horn is secured to the heel engaging portion so as to overlie that portion and facilitate placement and removal of the tree. In the preferred embodiment, the horn extends laterally of the heel-engaging portion so as to serve as a lever, and may be selectively removed for separate use as a shoe horn.

A principal object of the present invention is to provide a shoe tree having a shoe horn incorporated thereinto which may serve as a lever to facilitate placement of the tree.

Another object of the invention is to provide such a shoe tree wherein the shoe horn may be fabricated of a material different from that of the tree.

Still another object related to the latter object is to provide such a shoe tree wherein the horn may be adorned with a decorative design, identifying and/or advertising material.

Yet another object of the invention is to provide such a shoe tree wherein the horn may be selectively removed to facilitate the substitution of different colored horns, or for use separate from the tree.

A further object of the invention is to provide such a shoe tree wherein the heel-engaging portion is rotatable to cam the tree and subject a shoe within which it is received to internal compressive force.

Yet another object related to the latter object is to provide such a tree wherein the shoe horn serves as a lever to force the heel portion into a compressive state, and selectively release it from that state.

Still another object of the invention is to provide such a shoe tree wherein the heel and toeengaging portions are connected by a resiliently biased compressive strut and the heel engaging portion is rotatable to cam the strut into a state of high compression.

Yet a further object of the invention is to provide such a shoe tree wherein, upon rotation of the rear portion of the tree away from the front portion, the rear portion snaps clear of a shoe within which the tree is received.

Another and more specific object is to provide such a shoe tree wherein a compressive strut exerts force on the rear portion of the tree through a force line which moves upwardly relative to the contact area between the rear portion of the tree and a shoe within which it is received as the rear portion is rotated to remove the tree from the shoe.

These and other objects will become more apparent when viewed in the light of the following detailed description and accompanying drawings.

DESCRIPTION OF THE PREFERRED EMBODIMENTS

Figure 1:
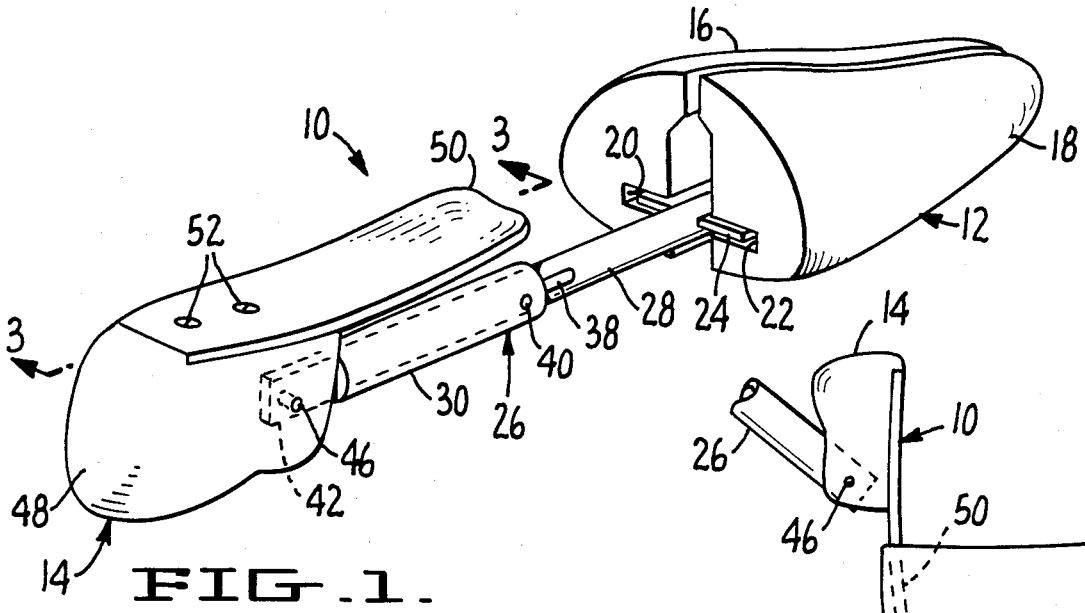
FIG. 1 is a perspective view of the inventive shoe tree.

The inventive shoe tree is illustrated in its entirety in FIG. 1 and designated by the numeral 10. It comprises a front or toe-engaging portion 12 conformed to fit within the toe of a shoe and a rear or heel-engaging portion 14 conformed to fit within the heel of a shoe. The toe-engaging portion 12 is split longitudinally so as to provide laterally expandible segments 16 and 18. Segments 16 and 18 are formed with opposed internal slots 20 and 22, respectively, which slidably receive a tapered cam plate 24. The lateral surfaces of the slots 20 and 22 converge toward the forward ends of the segments 16 and 18. The plate 24 is tapered so as to complementally engage said surfaces and force the segments 16 and 18 apart as the plate is forced forwardly within the slots. Suitable slidable pin connections (not illustrated) are provided between the segments 16 and 18 to prevent the segments from completely separating when the tree is removed from a shoe. It should be understood that the general construction of the slots 20 and 22, cam plate 24 and slidable pin connections is known in the prior art.

The heel and toe-engaging portions are articulatively connected by a compression strut 26. The strut is telescopic and comprises a forward inner section 28 and a rearward outer section 30. The section 28 is telescopically received within the section 30 and a compression coil spring (see FIG. 3) 32 is interposed between the closed end 34 of the section 30 and the inner end 36 of the section 28. A longitudinally extending slot 38 is formed through the section 28 and slidably receives a pin 40. The ends of the pin 40 are secured between openings in the section 30 and, thus, pin 40 serves to prevent the sections 28 and 30 from separating, while permitting limited telescopic movement thereof.

The forward or distal end of the section 28 is pivotally connected to the plate 24. Although not illustrated, it should be understood that this may be provided by a transversely extending bar provided on the plate 24 and a transversely extending opening provided in the section 28, which opening rotatably captures the bar.

The rearward end of the section 30 is formed with a generally vertically disposed tongue 42 which is received between side walls 44 formed integrally with the heel-engaging portion 14. A pin 46 is secured within and extends through the side walls and rotatably through an opening provided therefor in the tongue 42. The pin 46 mounts the heel-engaging portion 14 for rotation about an axis extending transversely of the strut 26. This axis is disposed eccentrically of the heel-engaging portion, with the result that rotation of the heel-engaging portion about the pin functions to lengthen the composite length of the shoe tree, as may be seen from a comparison of the phantom and solid line positions in FIG. 3. In the solid line lengthen position, the toe and heel-engaging portions of the tree are in general longitudinal alignment. As the heel engaging portion is moved to the phantom line position, it moves out of longitudinal alignment with the toe-engaging portion and the composite length of the shoe tree is shortened.

Figure 3:
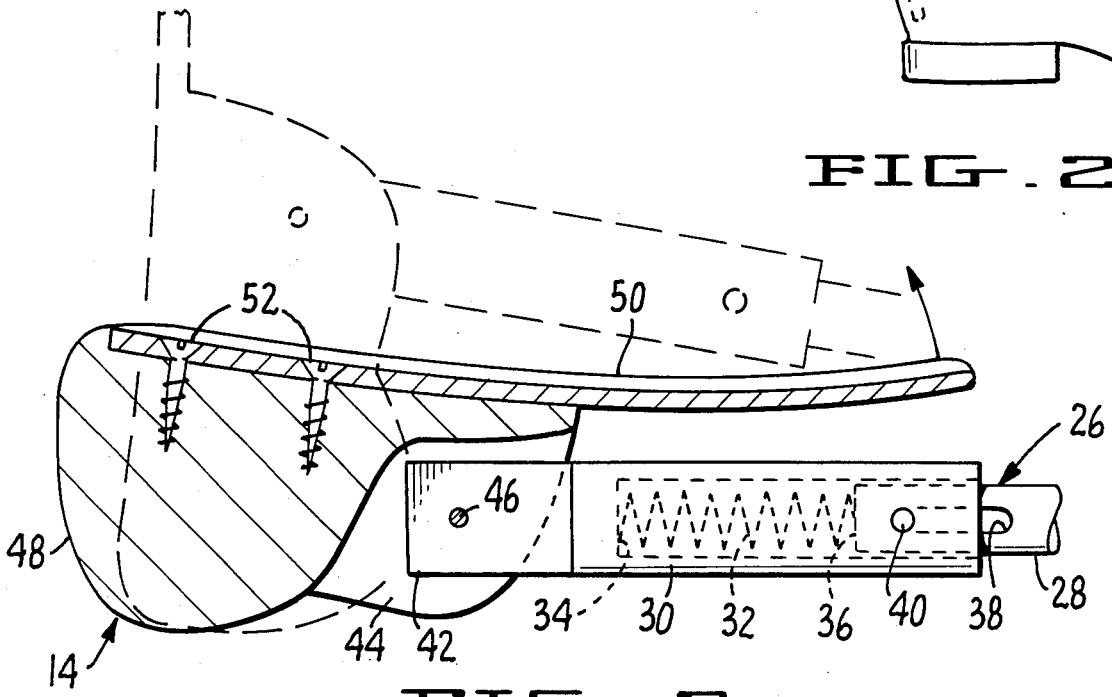
FIG. 3 is a cross-sectional view taken on the plane designated by line 3—3 of FIG. 1.

From FIG. 3, it will also be seen that the rear of the heel engaging portion 14 is rounded to provide a cam surface 48. This rounded surface configuration facilitates forcing of the heel-engaging portion into engagement with the internal surface of a shoe within which the tree is received.

Figure 2:
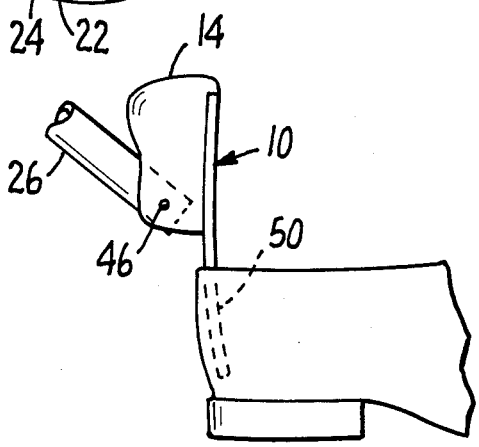
FIG. 2 is a side elevational view of a shoe, with the horn portion of the shoe tree as it would be placed to facilitate insertion of a foot into the shoe.

The top surface of the heel-engaging portion 14 carries a shoe horn 50 which extends laterally from the portion 14 in a forward direction. As shown in the embodiments of FIGS. 1 to 3, the horn 50 is secured to the top surface of the portion 14 by screws 52. The horn 50 serves as a lever to facilitate movement of the heel-engaging portion 14 between the solid and phantom line positions shown in FIG. 3. It may also be used as a horn, as shown in FIG. 2, to facilitate insertion of a foot into a shoe.

Figure 4:
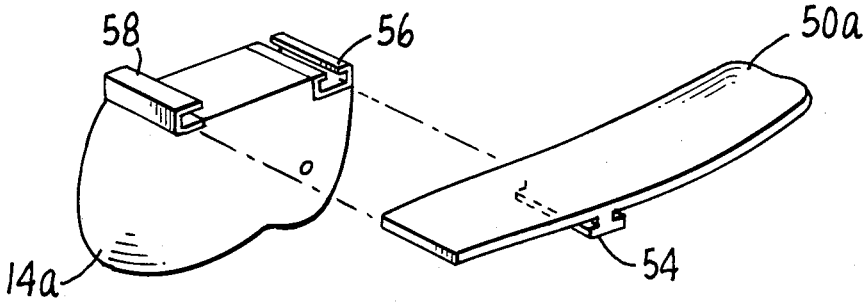
FIG. 4 is an exploded perspective view of an alternative embodiment of the heel-engaging portion of the inventive shoe tree, illustrating a removable tongue and groove section provided to permit the horn to be selectively removed.

The embodiment of FIG. 4 differs from that of FIGS. 1 to 3 only in that the shoe horn, designated **50*a* is connected to the heel-engaging portion, designated 14*a*, by a releasable tongue and groove connection, rather than a screw connection. The tongue and groove connection shown in FIG. 4 comprises a T-shaped tongue 54 formed on and extending transversely of the undersurface of the horn 50*a*, a forward channel 56 secured to and opening upwardly of the portion 14*a*, and a rearward channel 58 secured to and opening forwardly of the top surface of the portion 14*a*. The horn 50*a* is secured to the portion 14*a* by sliding the tongue 54 into the channel 56 simultaneously with sliding of the rearward distal end of the horn 50*a* into the channel 58. The connection thus provided is readily releasable. Ideally, there is sufficient frictional resistance between the tongue 54 and the channel 56 to prevent inadvertent displacement of the horn 50*a* from the heel portion 14*a***.

The modified embodiment of FIGS. 5 to 9 differs from the previously described embodiments primarily in that the rear or heel engaging portion **14*b* is formed as an integral unit and the strut 26*b* is reversed so that the larger telescopic portion 28*b* is pivotally secured between the sides of the toe engaging portion 12 and the smaller section 30*b* is pivotally secured within a slot 60 formed in the portion 14*b*. The slot is defined between spaced side walls 44*b* formed on the heel engaging portion 14*b***. Elements of the FIGS. 5–9 embodiment corresponding identically to those of the previously described embodiments are designated by like numerals. Elements corresponding to those of the previous embodiments, but differing in design detail, are designated by like numerals, followed by the subscript b.

Figure 7:
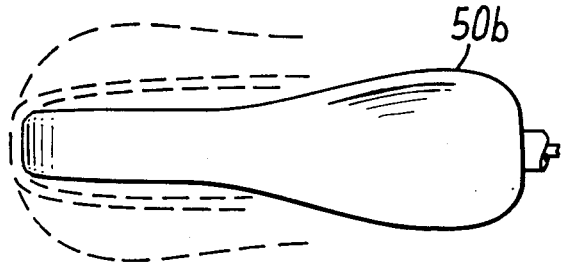
FIG. 7 is a plan view, with parts thereof broken away, taken on the plane designated by lines 7—7 of FIG. 6.
Figure 6:
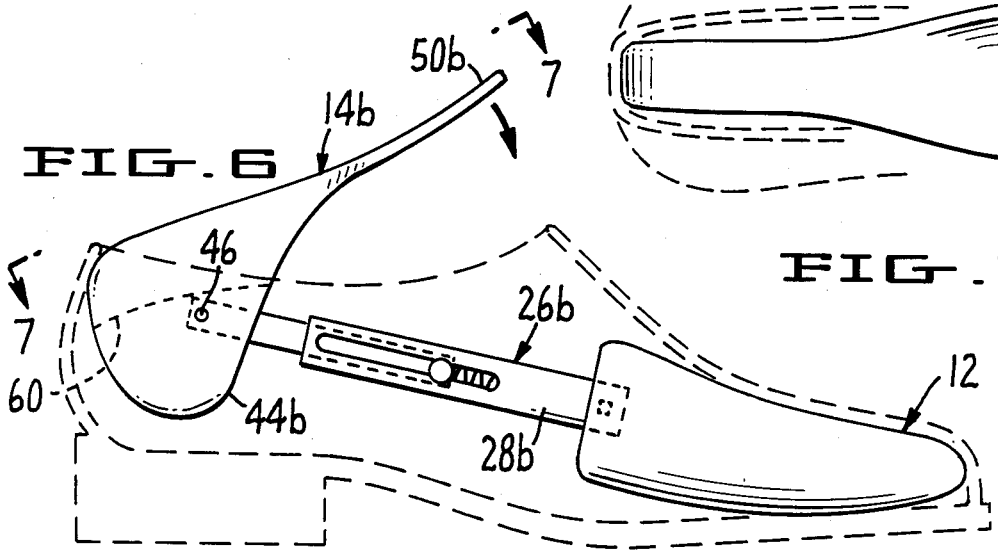
FIG. 6 is a side elevational view of the modified embodiment shown in FIG. 5, in the second step of being inserted into a shoe.
Figure 8:
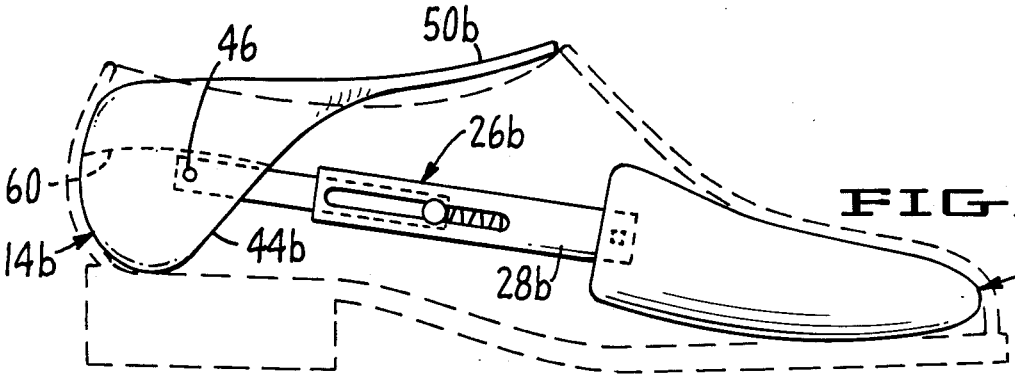
FIG. 8 is a side elevational view of the modified embodiment shown in FIG. 5, in the third and final step of being inserted into a shoe.

From FIGS. 5–9, it will be seen that the hinge pin 46 for the rear portion **14*b* is eccentrically disposed within the portion so as to be closer to its top, than its rear, as viewed in the fully inserted position shown in FIG. 8. This relationship results in increasing the compression on the strut 26*b* as the tree is inserted into a shoe (see the sequence of FIGS. 5–8). It also results in relaxing of the compression on the strut 26*b* as the heel engaging portion 14*b*** is rolled out of the shoe.

Figure 5:
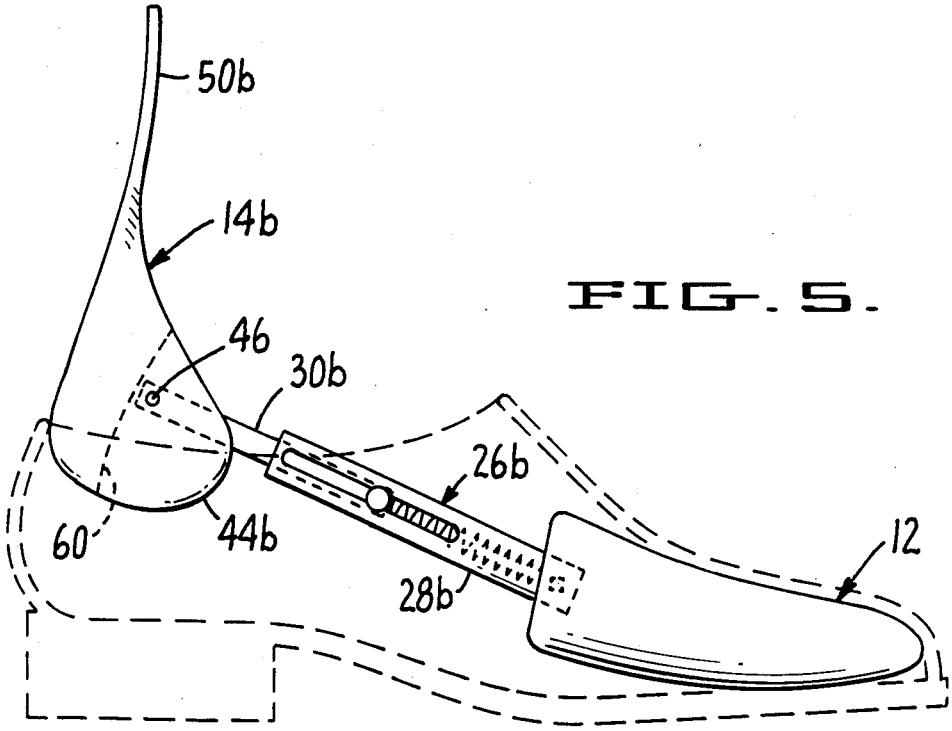
FIG. 5 is a side elevational view of a modified embodiment of the inventive shoe tree in the first step of being inserted into a shoe, such shoe being shown in phantom lines.

The progressive sequence shown in FIGS. 5, 7, and 8 illustrates how the rear portion **14*b* rolls into the shoe in response to clockwise swinging. From these Figs., it should also be evident that the horn 50*b*** serves as a lever to facilitate such swinging.

Figure 9:
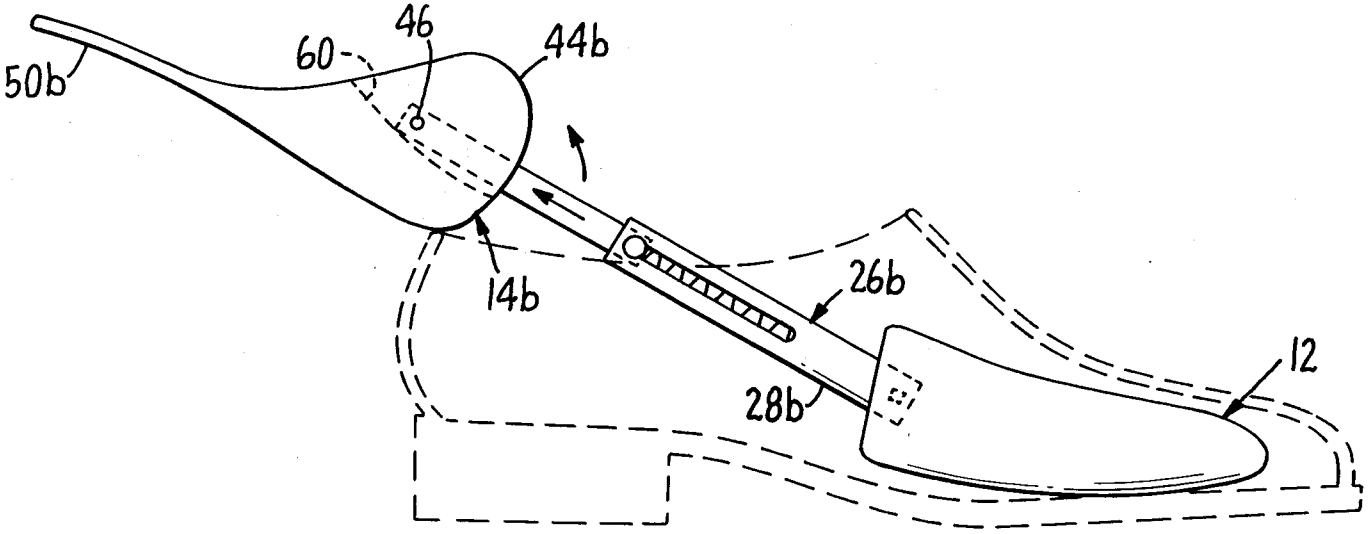
FIG. 9 is a side elevational view of the modified embodiment shown in FIG. 5, with the rear portion of the shoe tree being rolled out of the shoe and snapping clear therefrom.

Removal of the shoe tree from a shoe is carried out by reversing the steps shown in FIGS. 5, 7, and 8. Namely, the tongue **50*b* is lifted to swing the heel engaging portion 14*b* in a counter-clockwise direction, thus rolling the portion along the back interior surface of the shoe from the position shown in FIG. 8 to that shown in FIG. 5. During this rolling movement, a contact area is established between the back of the portion 14*b* and the inside back surface of the shoe, which area moves upwardly as the portion 14*b* is rotated in a counter-clockwise direction. In the initial stages of removal, as would correspond sequentially to the position shown in FIGS. 8 and 6, a contact area is above the line of force exerted by the strut 26*b* through the pin 46. As the tree reaches the position shown in FIG. 5, with the horn 50*b* in a generally vertical position, the area is markedly below that line of force. As a result, upon assuming the condition shown in FIG. 5 during removal, the force exerted by the strut functions to rotate the portion 14*b* counter-clockwise and kick it from the shoe, as shown in FIG. 9. Once the portion 14*b*** is so ejected from the shoe, it is a simple matter to pull the entire shoe tree out of the shoe.

In use, the shoe tree is placed within a shoe by first inserting the portion 12 within the toe of the shoe and then inserting the portion 14, **14*a*, 14*b* within the heel of the shoe, with the horn 50** raised to a nearly vertical position, as shown in FIGS. 3 and 5. The horn is then depressed to pivot the portion 14, 14*a* clockwise, as viewed in FIGS. 3 and 5, thus rolling the portion 14, 14*a* 14*b* into the shoe and imparting compression to the strut 2. Such compression, in turn, functions to laterally expand the segments 16 and 18. Removal of the tree from a shoe is carried out in reverse, by lifting the horn 50, 50*a*, 50*b* to rotate the heel-engaging portion 14, 14*a*, 14*b* in a counterclockwise direction, as viewed in FIGS. 3 and 9. Such lifting rolls the portion 14, 14*a*, 14*b* out of the shoe and facilitates removal of the tree from the shoe.

It should be appreciated that all embodiments of the invention provide a structure wherein heel engaging portion 14, 14*a*, 14*b* rolls into and out of the shoe and the horn 50, 50*a*, 50*b* serves as a lever to facilitate the rolling action. Additionally, upon being rolled out to a condition corresponding to that shown in FIG. 9, in all embodiments the heel engaging portion is snapped clear of the shoe by the compressive action of the strut 26, 26*b*.

Conclusion

From the foregoing description, it will be appreciated that the present invention enables the attainment of the objects initially set forth herein. In particular, the shoe tree provides an eccentrically mounted heel-engaging portion which may be rotated to compress or release the tree. The horn secured to the heel-engaging portion serves as a lever to facilitate its rotation and positioning and removal of the tree. The horn may also be used, as shown in FIG. 2, to facilitate insertion of a foot into the shoe. In the embodiment of FIG. 4, the horn may be used separately from the tree as a conventional shoe horn. In all embodiments, the heel engaging portion of the tree is designed to roll into and out of position and, during removal, to snap clear of the shoe within which it is used.

While preferred embodiments have been illustrated and described it should be understood that the invention is not intended to be limited to the specifics of these embodiments, but rather is defined by the accompanying claims.

What is claimed is:

1. A shoe tree comprising: a front portion conformed to fit within the toe area of a shoe; a rear portion conformed to fit within the heel area of a shoe; a compressible strut between said front and rear portions; first connecting means securing the front portion in generally longitudinally aligned compression imparting relationship to the strut; second connecting means securing the rear portion to the strut for pivotal movement about an axis eccentrically disposed relative to said rear portion and extending transversely of the strut, whereby swinging of the rear portion about said axis downwardly toward the front portion and into generally longitudinally aligned relationship with the strut functions to extend the composite length of the tree and swinging of the rear portion about said axis upwardly away from the front portion functions to reduce the composite length of the tree and roll the rear portion out of a shoe within which the tree is received; and a shoe horn secured to the rear portion so as to overlie said portion, said horn extending forwardly of the rear portion over and in spaced relationship to the strut when the rearward portion is longitudinally aligned with the strut, whereby said horn may be gripped from beneath to swing the rear portion away from the front portion.

2. A shoe tree according to claim 1 wherein the axis is so positioned relative to the rearward portion that the strut functions to snap the rearward portion out of a shoe within which the tree is received upon swinging of the rear portion away from the front portion to a position where the horn is disposed generally vertically.

3. A shoe tree according to claim 1, wherein: a limited contact area is formed between the rear portion and the interior of a shoe within which the tree is received; the strut imparts force to the rear portion through a force line passing through the axis; and said force line moves upwardly to an elevated position relative to said contact area as the rear portion is swung to roll out of the shoe.

4. A shoe tree according to claim 3 wherein said force line moves from a position below to a position above said contact area as the rear portion is swung to roll out of the shoe.

5. A shoe tree according to claim 3, wherein said strut is telescopic and spring biased to an extended condition.

6. A shoe tree comprising: a front portion conformed to fit within the toe area of a shoe; a rear portion conformed to fit within the heel area of a shoe; a compression strut secured between said front and rear portions; means connecting the rear portion to the strut for rotational movement relative thereto about an eccentric axis whereby swinging of the rear portion downwardly toward the front portion functions to move the rear portion into an extended condition generally longitudinally aligned relative to the front portion and swinging of the rear portion about said axis away from the front portion functions to move the rear portion into a contracted nonaligned condition relative to the front portion; a rounded rearward surface on the rear portion for rolling engagement with the inner rear surface of a shoe within which the tree is received upon rotational movement of the rear portion relative to the strut; and, a shoe horn connected to the rear portion in a disposition extending toward and longitudinally of the front portion in spaced relationship to the strut when the front and rear portions are disposed in generally longitudinally aligned condition, said horn providing a lever grippable from the underside to facilitate movement of the rear portion between said extended and contracted conditions to roll the rear portion out of a shoe within which the tree is received.

7. A shoe tree according to claim 6, wherein: a limited contact area is formed between the rounded rearward surface and the inner rear surface of a shoe within which the tree is received; the strut imparts force to the rear portion through a force line passing through the axis; and said force line moves upwardly to an elevated position relative to said contact area as the rear portion is swung to roll out of the shoe.

8. A shoe tree according to claim 7 wherein said force line moves from a position below to a position above said contact area as the rear portion is swung to roll out of the shoe.

9. A shoe tree according to claim 6 wherein, when the rear portion is in the extended condition, the distance between the axis and the rearward surface of the rear portion is greater than the distance between the axis and the top of the rear portion.

10. A shoe tree comprising: a front portion conformed to fit within the toe area of a shoe; a rear portion conformed to fit within the heel area of a shoe; means securing said front and rear portions together whereby such portions impart internal compression force to the interior of a shoe when disposed therein; and a shoe horn secured to the rear portion so as to overlie said rear portion, said horn serving as a handle to facilitate placement of the tree within a shoe and removal of the tree from a shoe, said horn being secured to the rear portion through a tongue and groove connection between the rear portion and the horn, said connection providing for select lateral movement of the horn relative to the rear portion to effect release of the horn from the rear portion.

* * * * *